US005595334A

United States Patent [19]

Belec et al.

[11] Patent Number: 5,595,334

[45] Date of Patent: Jan. 21, 1997

[54] VACUUM AND TRACTOR DRIVE FOR PAPER WEB

[75] Inventors: Eric A. Belec, Southbury; Eric J. Janatka, Danbury; Shahzad H. Malick, Fairfield, all of Conn.; Rebecca J. Pritting, Pawling, N.Y.

[73] Assignee: Pitney Bowes Inc., Stamford, Conn.

[21] Appl. No.: 543,673

[22] Filed: Oct. 16, 1995

[51] Int. Cl.[6] ..... B65H 20/10; B65H 20/22

[52] U.S. Cl. ..... 226/15; 226/74; 226/95; 226/111

[58] Field of Search ..... 226/95, 74, 75, 226/172, 111, 15

[56] References Cited

U.S. PATENT DOCUMENTS

| | | | |
|---|---|---|---|
| 3,140,030 | 7/1964 | Stewart | 226/95 |
| 3,317,102 | 5/1967 | Lizotte | 226/75 |
| 3,499,614 | 3/1970 | Badum | 226/95 |
| 3,681,779 | 8/1972 | Darnell | 226/95 |
| 3,915,291 | 10/1975 | Vogts | 226/95 |
| 4,462,527 | 7/1984 | Taylor et al. . | |
| 4,485,949 | 12/1984 | Gebhart et al. . | |
| 4,890,140 | 12/1989 | Negoro et al. | 226/74 |
| 5,271,541 | 12/1993 | Roux | 226/95 |
| 5,348,278 | 9/1994 | Ring . | |
| 5,374,042 | 12/1994 | Ring . | |

FOREIGN PATENT DOCUMENTS

| | | | |
|---|---|---|---|
| 4223959 | 8/1992 | Japan | 226/95 |

OTHER PUBLICATIONS

IBM Technical Disclosure—Eichorn, "Feeding Apparatus for Continuous and Cut Forms"; Jan., 1964; vol. 6, No. 8, p. 91.

IBM Technical Disclosure—Kaufman and Krautwald, "Paper Feed Device"; Nov., 1972; vol. 15, No. 6, pp. 1990–1991.

*Primary Examiner*—Daniel P. Stodola
*Assistant Examiner*—Matthew A. Kaness
*Attorney, Agent, or Firm*—Lawrence E. Sklar

[57] ABSTRACT

Apparatus for transporting a web of paper having tractor holes along only one margin thereof. The apparatus includes: a tractor drive having a first pair of pulleys and a first belt mounted on the first pair of pulleys, the first belt having a plurality of sprockets for engaging the paper tractor holes; and an auxiliary vacuum drive system for engaging the marginal portion of the web of paper without tractor holes, the auxiliary drive system having (a) a second pair of pulleys and a second belt mounted on the second pair of pulleys, the second belt having a plurality of apertures at equally spaced intervals extending longitudinally of the length of the second belt, the second belt having an upper and lower reach, (b) a device for applying a vacuum to the apertures in the upper reach of the second belt, (c) a device for varying the amount of vacuum applied and (d) a device for driving the upper reach of the second belt at about the same linear velocity as the linear velocity of the tractor drive sprockets, whereby the vacuum can be turned off during constant velocity or deceleration motions of the web, thereby dissipating tolerance build-up between the tractor drive and the auxiliary vacuum drive system.

5 Claims, 4 Drawing Sheets

VACUUM AND TRACTOR DRIVE FOR PAPER WEB

BACKGROUND OF THE INVENTION

The instant invention relates to apparatus for driving paper webs having tractor holes, and more particularly to auxiliary drive apparatus for webs having tractor holes on only one side of the web.

Many paper handling systems, such as envelope inserting systems, employ paper webs which are ultimately severed into discrete sheets. Typically, the paper web includes tractor holes on both longitudinal margins which are engaged by the pins of a tractor drive. As web handling applications have become increasingly complex, there has developed a need for the capability to process paper webs having tractor holes on only one side, e.g. "center-slit" and "two-up" applications.

With a single side tractor drive scheme, the paper forces, such as acceleration and deceleration, have a tendency to skew the paper web as the web is processed at high speeds, thereby yielding unacceptable cut and slit geometries and high jam frequencies. Since all paper webs eventually must be cut or severed in some way into discrete sheets, and because traditional severing and transport mechanisms do not function well when driving a web by only one set of tractor holes, an enhanced drive scheme is required to enable a web with only a single set of tractor holes to be processed at the high speeds, accelerations and decelerations associated with "state-of-the-art" performance.

There have been many attempts to provide such an enhanced drive scheme for webs with one set of tractor holes. Most frequently, a friction roller and associated idler roller are fashioned to drive the non-tractor driven edge of the web. The roller is driven by the spline that typically drives the tractor assemblies. Unfortunately, it is virtually impossible to consistently maintain the necessary part geometries (roller diameter) to have the friction roller system work in concert with the associated tractor on the other side of the web. If the roller varies by even +/–0.001", every revolution of the roller will yield a tolerance build-up of 0.003 inch. After 20 revolutions, the cumulative error will be approximately 0.060". The additive nature of this tolerance build-up quickly results in jam conditions. Some of the attempts have incorporated the opportunity for the roller to slip and relieve this tolerance build-up, but this adaptation yields poor paper handling characteristics and has an extremely sensitive system set-up. These problems are compounded as the paper characteristics (weight, thickness, surface finish, etc.) are varied.

Accordingly, the instant invention provides an auxiliary drive to the non-tractor driven edge of a paper web so that a transport force can be applied to that edge of the web without the need for tractor holes. The auxiliary drive of the instant invention applies positive web transport forces to the non-tractor driven side of the paper web while allowing tolerance build-up between the auxiliary drive and the tractor drive to be easily and quickly dissipated.

SUMMARY OF THE INVENTION

Accordingly, the instant invention provides apparatus for transporting a web of paper having tractor holes along only one margin thereof. The apparatus includes: a tractor drive having a first pair of pulleys and a first belt mounted on said first pair of pulleys, said belt having a plurality of sprockets for engaging said paper tractor holes; and an auxiliary vacuum drive system for engaging the marginal portion of said web of paper without tractor holes, said auxiliary drive system having (a) a second pair of pulleys and a second belt mounted on said second pair of pulleys, said second belt having a plurality of apertures at equally spaced intervals extending longitudinally of the length of said second belt, said second belt having an upper and lower reach, (b) means for applying a vacuum to the apertures in the upper reach of said second belt, (c) means for varying the amount of vacuum applied and (d) means for driving the upper reach of said second belt at about the same linear velocity as the linear velocity of the tractor drive sprockets, whereby the vacuum can be turned off during constant velocity or deceleration motions of the web, thereby dissipating tolerance build-up between said tractor drive and said auxiliary vacuum drive system.

DETAILED DESCRIPTION OF THE PREFERRED EMBODIMENT

Figure 1:
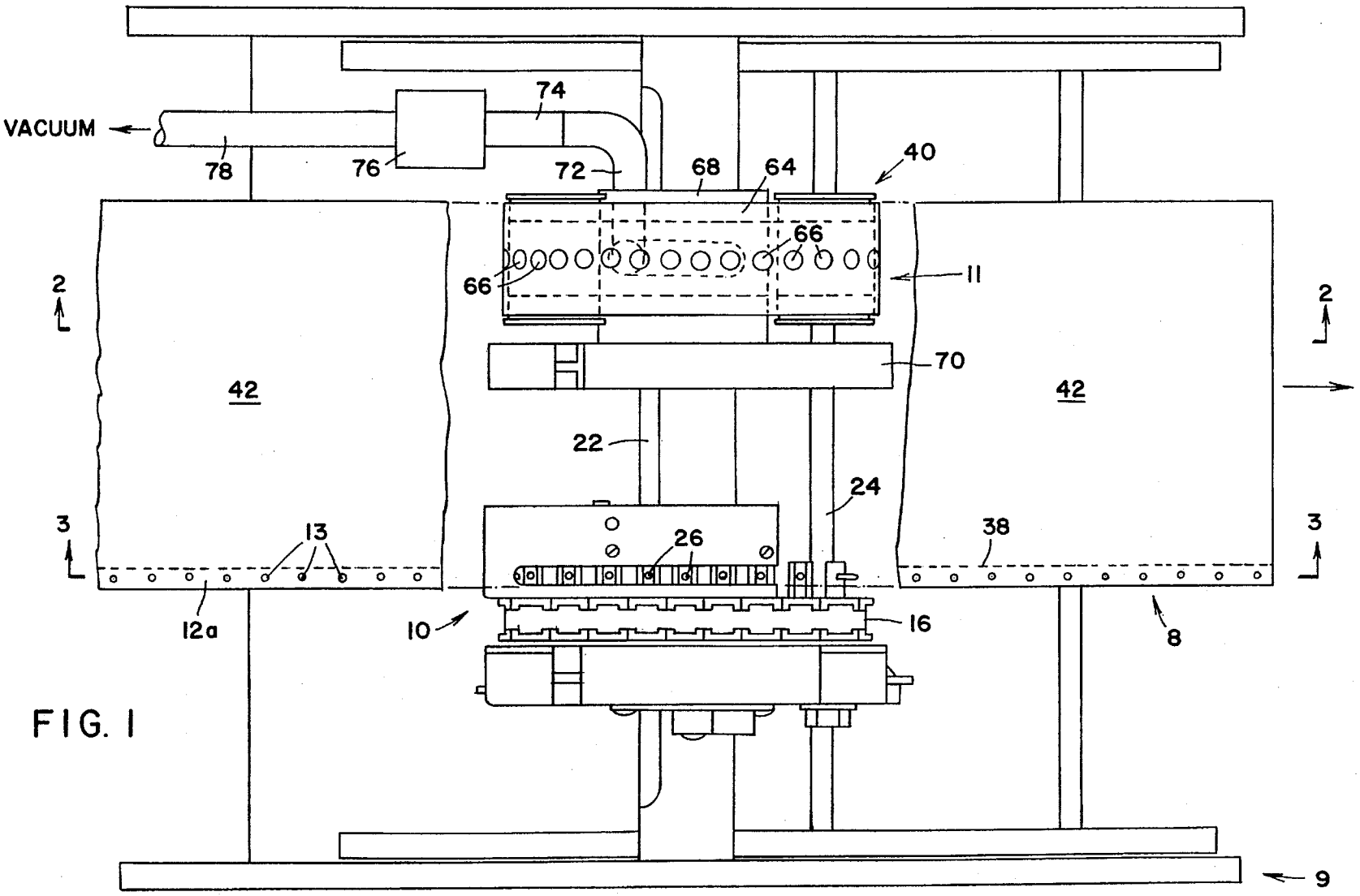
FIG. 1 is a top, plan view of drive apparatus for 2 webs of paper each having tractor holes on only one side in accordance with the instant invention.
Figure 2:
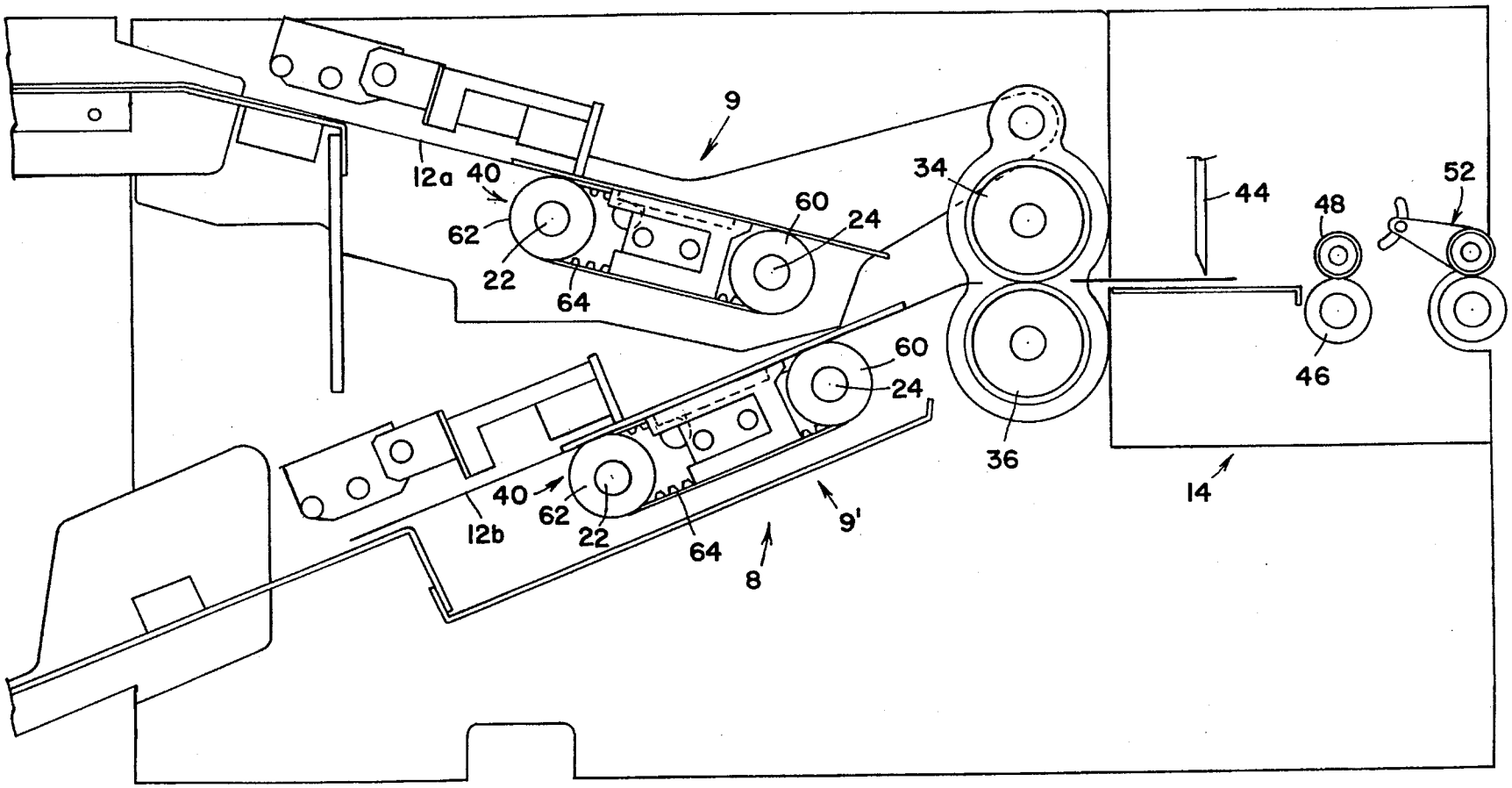
FIG. 2 is a sectional view taken on the plan indicated by the line 2—2 in FIG. 1.
Figure 3:
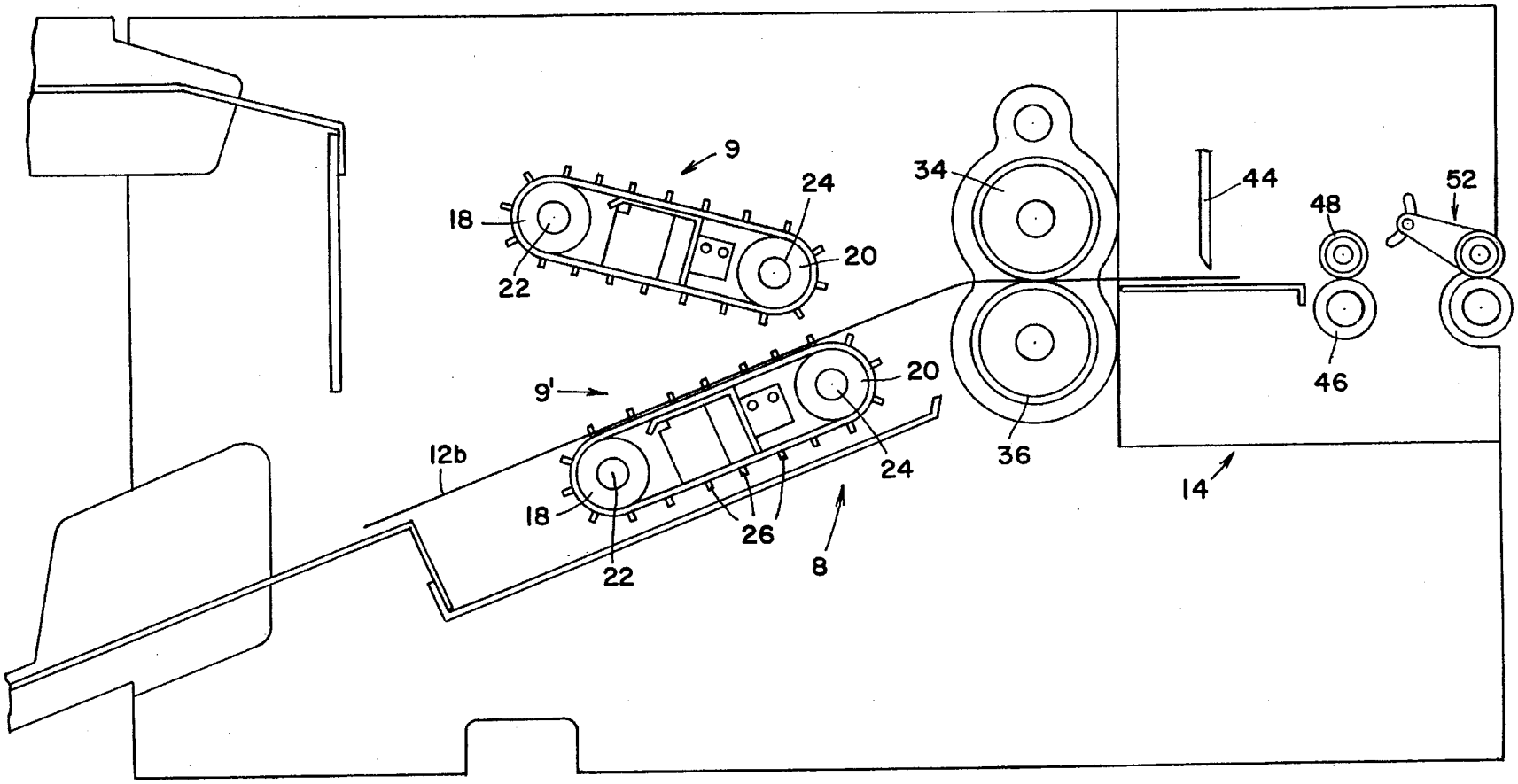
FIG. 3 is a sectional view taken on the plane indicated by the line 3—3 in FIG. 1.

In describing the preferred embodiment of the instant invention, reference is made to the drawings, wherein there is seen a dual web paper transport system generally designated 8 consisting of an upper paper transport generally designated 9 (see FIGS. 1–3) and a lower paper transport generally designated 9' which is virtually identical to but opposite the upper transport 9. The transport system 8 feeds two portions 12*a* and 12*b* of a web of paper which was previously integral but was slit into the two parallel, longitudinal sections 12*a* and 12*b* by upstream slitting apparatus (not shown). Each resultant web section 12*a* and 12*b* includes only one set of tractor holes 13 along one margin thereof. The two webs 12*a* and 12*b* are fed by the transports 9 and 9' respectively toward a cutting device generally designated 14 (see FIGS. 2 and 3). Each transport 9 and 9' includes a tractor drive 10 and an auxiliary drive 11 for driving the webs 12*a* and 12*b* toward the cutting device 14. Each tractor drive 10 includes a timing gear belt 16 endlessly looped about an upstream idler pulley gear roller 18 and a downstream drive pulley gear roller 20 (see FIG. 3). The tractor drives 10 can also employ other types of belts, such as flat belts, as well as chains. Each idler pulley roller 18 is conventionally mounted for rotation on an idler shaft 22 and each drive pulley gear roller 20 is fixedly mounted on a drive shaft 24, which is driven by conventional drive means.

Each timing belt 16 includes a plurality of sprockets 26 outwardly protruding therefrom at equally spaced intervals, longitudinally of the length thereof, which correspond to the spacing between the sprocket holes 13 formed in the margin strips 38 (only one is shown) of the webs 12*a* and 12*b*. Each transport 9 and 9' includes an auxiliary drive system 40 which will be described in detail hereinbelow.

Figure 4:
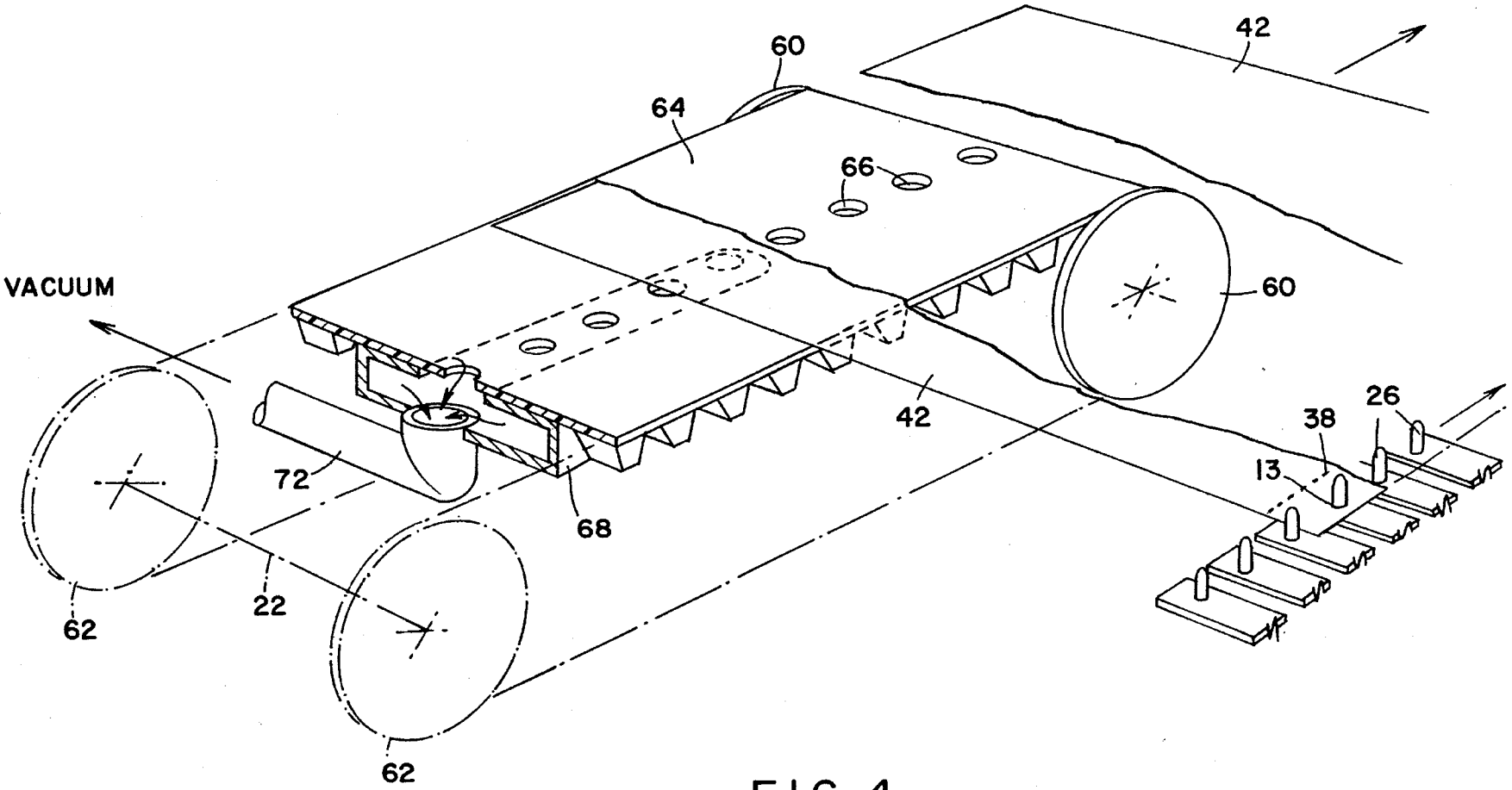
FIG. 4 is a perspective view of the auxiliary web drive in accordance with the instant invention.

The cutting device 14 includes two pairs of conventional, stationary slitter knives 34 (only one is shown) and 36 (only one is shown). The slitter knives 34 and 36 cause the margin strips (see FIGS. 3 and 4) 38 to be severed from the advancing webs 12*a* and 12*b*. The severed margin strips 38 and the remaining main portion 42 of the webs 12*a* and 12*b* are then driven by the timing belts 16 and auxiliary drive system 40 toward a reciprocating knife 44 (see FIG. 1) and a pair of drive rollers 46 and driven rollers 48 (only one of each is shown). Once the main portion 42 of the web 12*a* and 12*b* and the severed margin strips 38 are gripped by the drive rollers 46 and driven rollers 48, the reciprocating knife 44 is lowered to cut the main web portion 42 laterally into individual, discrete sheets of paper (not shown). Once the margin strips 38 are severed by the slitter knives 34 and 36, the strips 38 continue to get fed by the sprockets 26 into the nip of the drive rollers 46 and driven rollers 48. The margin strips 38 flow downward away from the remaining, discrete sheets of paper to an area (not shown) where the strips 38 can be removed as scrap paper. The discrete sheets are fed away from the cutting device 14 and ultimately are engaged by additional paper handling apparatus 52 downstream for further processing, such as collating, folding, and inserting into an envelope.

Referring now to the auxiliary drive system 11, each of the paper transports 9 and 9' includes an auxiliary drive system 11 for assisting the tractor drive 10 in driving the webs 12*a* and 12*b*. Each auxiliary drive 11 includes a drive pulley 60 secured to the drive shaft 24 and an idler pulley 62 rotatably mounted on the idler shaft 22. A vacuum belt 64 in the form of a timing belt is mounted on the pulleys 60 and 62; the vacuum belt 64 includes a plurality of apertures 66 which pass over a vacuum manifold 68 which is secured to a support block 70. An inlet port 72 is connected to the vacuum manifold and a first vacuum hose 74 which is connected through a valve 76 to a second vacuum hose 78 which in turn is connected with a source of vacuum (not shown).

The foregoing arrangement of the auxiliary drive systems 11 allows vacuum to be applied (providing positive transport force) during the acceleration of the webs 12*a* and 12*b* and eliminated momentarily during either the constant velocity or decelerating motions of the webs 12*a* and 12*b*. By applying a vacuum force through the belt apertures 66 which are situated under the "free" edge (no tractor holes) of the webs 12*a* and 12*b*, each of the webs 12*a* and 12*b* will be positively driven by the vacuum belt 64 for the period of time during which vacuum is "pulled" through the apertures 66. Any tolerance build-up between the tractor drive 10 and the auxiliary vacuum drive system 11 can be dissipated or eliminated by simply turning off valve 76. As the webs 12*a* and 12*b* are stopped to allow for the cutting cycle to be executed by the cutting device 14, the vacuum can once again be valved on to provide positive transport forces for the next successive sheets.

It should be noted that the linear velocity of each of the upper reaches 63 of the auxiliary drive vacuum belts 64 should closely approximate the linear velocity of the sprockets 26 of the associated tractor drive 10. It would be desirable if the velocities of the belts 64 and the associated tractor drive sprockets 26 matched perfectly, but this is usually impossible to achieve. The instant invention utilizes a system which allows differences between the speeds of the auxiliary drive 11 and the tractor drive 10 to be dissipated, and thus an exact match of speeds is not necessary.

From the foregoing description, it can be seen that the instant invention provides positive web transport forces to the non-tractor driven side of the webs 12*a* and 12*b* while allowing tolerance build-up between the tractor drive 10 and the auxiliary drive 11 to be quickly and easily dissipated, and just as importantly, compounding of the tolerance build-up is eliminated. It should be noted that no adjustments are necessary for difference paper types, i.e. papers that differ in weight, thickness, surface finish, etc.

It should be understood by those skilled in the art that various modifications may be made in the present invention without departing from the spirit and scope thereof, as described in the specification and defined in the appended claims.

What is claimed is:

1. Apparatus for transporting a web of paper having tractor holes along only one margin thereof and a marginal portion without tractor holes, comprising:

a tractor drive having a first pair of pulleys and a first belt mounted on said first pair of pulleys, said first belt having a plurality of sprockets adapted to engage said paper tractor holes; and an auxiliary vacuum drive system for engaging the marginal portion of said web of paper without tractor holes, said auxiliary drive system having (a) a second pair of pulleys and a second belt mounted on said second pair of pulleys, said second belt having a plurality of apertures at equally spaced intervals extending longitudinally of the length of said second belt, said second belt having an upper and lower reach, (b) means for applying a vacuum to the apertures in the upper reach of said second belt, (c) means for varying the amount of vacuum applied by said vacuum applying means, and (d) means for driving the upper rack of said second belt at about the same linear velocity as the linear velocity of the tractor drive sprockets, whereby the vacuum applying means can be turned off during constant velocity or deceleration motions of the web, to dissipate tolerance build-up due to speed differential between said tractor drive and said auxiliary vacuum drive system.

2. The apparatus of claim 1, additionally comprising a housing frame, a drive shaft mounted in said housing frame, an idler shaft mounted in said housing frame upstream of said drive shaft, and wherein said first pair of pulleys are mounted on said drive and idler shafts and said second pair of pulleys are secured to said drive and idler shafts.

3. The apparatus of claim 2, wherein said vacuum varying means comprises a valve.

4. The apparatus of claim 3, wherein said first and second belts comprise timing gear belts.

5. The apparatus of claim 4, wherein said apertures are located under the margin of said web of paper not having tractor holes.

* * * * *

UNITED STATES PATENT AND TRADEMARK OFFICE

CERTIFICATE OF CORRECTION

PATENT NO. : 5,595,334

DATED : January 21, 1997

INVENTOR(S) : Eric A. Belec, Eric J. Janatka, Shahzad H. Malick, Rebecca J. Pritting It is certified that error appears in the above-indentified patent and that said Letters Patent is hereby corrected as shown below:

Column 4, Claim 1, line 37, please change "rack" to --reach--.

Signed and Sealed this

Twenty-ninth Day of April, 1997

Bruce Lehman

*Attest:*

BRUCE LEHMAN

*Attesting Officer*

*Commissioner of Patents and Trademarks*